US005361838A

United States Patent [19]

Kilgore

[11] Patent Number: 5,361,838

[45] Date of Patent: Nov. 8, 1994

[54] SLICK LINE CASING AND TUBING JOINT LOCATOR APPARATUS AND ASSOCIATED METHODS

[75] Inventor: Marion D. Kilgore, Dallas, Tex.

[73] Assignee: Halliburton Company, Houston, Tex.

[21] Appl. No.: 146,678

[22] Filed: Nov. 1, 1993

[51] Int. Cl.[5] ..... E21B 47/09; G01V 3/11; G01V 3/28

[52] U.S. Cl. ..... 166/255; 73/151; 166/64; 166/65.1; 166/66.4; 324/221

[58] Field of Search ..... 166/255, 250, 65.1, 166/66.4, 64; 73/155; 324/221, 220, 326; 340/854.2

[56] References Cited

U.S. PATENT DOCUMENTS

| | | | |
|---|---|---|---|
| 2,476,137 | 7/1949 | Doll | 166/255 X |
| 2,602,833 | 7/1952 | Swift | 175/183 |
| 2,746,550 | 5/1956 | Mitchell, Jr. | 166/255 |
| 2,967,994 | 1/1961 | Peterson | 324/221 |
| 3,019,841 | 2/1962 | Ternow | 166/55.1 |
| 3,088,068 | 4/1963 | Hall, Jr. et al. | 324/221 |
| 3,291,208 | 12/1966 | Kenneday | 166/255 |
| 3,396,786 | 8/1968 | Schuster et al. | 166/255 |
| 3,434,046 | 3/1969 | Wilson et al. | 324/221 X |
| 3,902,361 | 9/1975 | Watson | 73/151 |
| 4,023,092 | 5/1977 | Rogers | 324/221 |
| 4,067,386 | 1/1978 | Weise | 166/64 |
| 4,794,336 | 12/1988 | Marlow et al. | 324/221 |

*Primary Examiner*—Stephen J. Novosad
*Attorney, Agent, or Firm*—Tracy W. Druce; J. Richard Konneker

[57] ABSTRACT

An electromechanical detector structure is used to sense and log the joints in a downhole jointed tubular structure, such as a well bore casing or production tubing, in a subterranean well. The detector is lowered into the tubular structure on an elongated positioning member, representatively a slick line, through a series of joints to be logged, and then pulled upwardly through the joints. As the detector passes upwardly through each joint it electromagnetically senses the joint and responsively generates an electric output signal. The output signal is used to momentarily drive a drag structure portion of the detector into forcible, motion inhibiting contact with the interior surface of the tubular structure. This, in turn, momentarily creates a detectable tension increase in the elongated positioning member. These tension increases serve as mechanical output signals transmitted upwardly through the positioning member, and may be plotted on a strip chart recorder at the surface to record the joint locations and correlate them to the lowered depth odometer readings of the detection system. Using this electromechanical joint detection apparatus, correlative joint logging procedures may be carried out for tool setting purposes without the necessity of utilizing an electrical conductor line.

26 Claims, 3 Drawing Sheets

SLICK LINE CASING AND TUBING JOINT LOCATOR APPARATUS AND ASSOCIATED METHODS

BACKGROUND OF THE INVENTION

The present invention generally relates to well logging apparatus and, in a preferred embodiment thereof, more particularly relates to apparatus and methods for detecting joints at adjacent sections of a jointed tubular structure, such as a bore hole casing or production tubing, in a subterranean well.

It is often necessary in a completed subterranean well to precisely locate one or more of the joints that join the various longitudinal sections of a jointed tubular structure, such as a bore hole casing or production tubing. This need arises, for example, when it is necessary to precisely locate a tool such as a perforating gun, or another downhole structure such as a packer, within the jointed tubular structure relative to a well structure previously installed therein, such as a set of casing perforations. The tool to be set at a predetermined location within the tubular structure is typically lowered into the tubular structure on an elongated positioning member such as a slick line or a length of coil tubing, and the depth of the previously installed well structure may be readily found on the previously recorded joint and tally log for the well.

Given this readily available information it would seem at first glance to be a rather straightforward task to simply lower the tool into the tubular structure until the lowered depth odometer reading for the elongated positioning member was equal to the indicated joint log and tally depth for the previously installed well structure plus (or minus as the case may be) the desired offset distance between the tool to be set and the previously installed well structure. However, due to the considerable stretch of the elongated positioning member at substantial tool lowering depths, this approach is often characterized by an unacceptably low degree of tool positioning accuracy. Specifically, the odometer reading is not identical to the actual lowered depth of the tool.

For years the drilling and well services have employed various correlative joint logging techniques to indirectly overcome these tool positioning inaccuracies. One such technique entails the lowering of an electronic joint sensor into the jointed tubular structure on an electrically conductive wireline to detect a spaced series of joints in the general vicinity of the desired tool positioning location, and determine the lengths between the adjacent pairs of joints using the joint-to-joint odometer readings.

Using the fact that the joint-to-joint lengths in a jointed tubular structure such as a bore hole casing or production tubing tend to be detectably nonuniform, the series of determined joint-to-joint lengths are "matched" to an identical series of joint-to-joint lengths on the previously recorded joint and tally log to identify precisely which series of joints have been detected. Using this correlated logging information, a precise correspondence between the odometer readings and the actual lowered depth of the joint sensor may be arrived at. In turn, this information may be used to determine an odometer reading precisely corresponding to the desired tool setting depth and the tool may then be lowered to this odometer reading with its precise positioning assured.

During this joint logging procedure, as the joint sensor is longitudinally moved, on the electrically conductive wireline, through the general tubular structure vicinity of interest it electromagnetically detects mass changes in the tubular structure indicative of the joints therein. Upon detecting a joint the sensor responsively generates an electrical signal pulse which is appropriately amplified and transmitted to the surface through the wireline. These electrical signal pulses are transmitted to and imprinted on an appropriate single pin strip chart recorder side-by-side with the corresponding lowered depth odometer readings. In addition to the post-completion correlative logging operations described above, wireline joint logging may also be used in initial logging procedures to establish, for example, the joint and tally log itself.

While wireline logging operations of this type are quite accurate, they also tend to be undesirably expensive, particularly in subsequent correlation logging operations for tool setting purposes, due to wireline footage charges and the crew and surface equipment typically required to carry out the wireline logging operations.

Heretofore the use of slick line (such as monofilament steel cable) in downhole tool setting procedures requiring correlative logging, although potentially less expensive than its wireline counterpart, has not been considered practical because of the inability to accurately correlate the location of the tool connected to the slick line with the location of previously installed well structures. Stated in another manner, while various sophisticated and relatively expensive equipment may be used in conjunction with a slick line to compensate for line stretch inaccuracies and precisely determine the depth of the tool in the tubular structure, conventional slick line tool setting systems have not had the capability of also performing the correlative logging functions necessary to precisely locate the tool relative to previously installed equipment in the jointed tubular structure.

In addition to electronic joint detectors of the type described above, various mechanical joint detectors have also been proposed. These types of detectors are typically provided with radially biased finger structures that resiliently enter the interior recesses of "cavity" type joints and provide detectable weight variations on the weight indicator at the surface when the finger structures snap into the joint recesses as the joint sensor is longitudinally moved through the tubular structure. The weight indicator variations constitute mechanical joint detection signals which may be used in the location of tools within a jointed tubular structure.

While mechanical joint detection apparatus of this general type does not require the transmission of electrical signals to the surface, and thus avoid the attendant expense of an electrically conductive wireline, it also has a decidedly undesirable limitation in that it can only detect joints of the cavity type. It cannot be used to detect "flush" type joints since joints of this type do not have interior recesses for the mechanical joint detector finger structures to snap into.

From the foregoing it can be readily seen that a need exists for improved tubular structure joint detection apparatus and associated methods that eliminate, or at least substantially minimize, the above-mentioned problems, limitations and disadvantages typically associated with conventional joint detection apparatus and methods. It is accordingly an object of the present invention to provide such improved apparatus and methods.

SUMMARY OF THE INVENTION

In carrying out principles of the present invention, in accordance with a preferred embodiment thereof, electromechanical detection apparatus is provided for detecting joints, or other changed mass sections of a jointed tubular structure (either increased or decreased mass sections therein), such as a bore hole casing or production tubing, in a subterranean well. Using the apparatus, joints of either the cavity or flush type may be detected without the necessity of using an electrical conductor line to lower the apparatus into the jointed tubular structure.

From a broad standpoint the apparatus comprises a mass change detection structure, movable through a well bore jointed tubular structure (for example, a well bore casing or production tubing) on an end of an elongated positioning member, such as a slick line, a braided metal cable, or a length of coil tubing, and operable to detect the locations of a spaced series of joints or other changed mass sections of the tubular structure. The detection structure includes first means for sensing each changed mass tubular structure portion through which the detection structure passes as it is moved through the tubular structure on the elongated positioning member, and responsively generating an electrical output signal.

Second means, responsive to the generation of each electrical output signal, are operative to bring a portion of the joint detection structure into forcible contact with the tubular structure in a manner momentarily inhibiting the further movement of the joint detection structure through the tubular structure and thereby creating in the elongated positioning structure detectable tension increases indicative of the downhole positions of the sensed increase or decrease in tubular structure mass.

The conventional need to transmit electrical signals through the elongated positioning member is thus advantageously eliminated. Instead, each joint, upset or other changed mass section of the tubular structure is electrically sensed by the first means, representatively using electromagnetic sensing means, and the detection structure utilizes the output of the electromagnetic sensing means to responsively operate the second means to generate mechanical joint detection signals in the elongated positioning member which may be correlated to lowered length odometer readings at the surface to determine the depth of the joints being logged. Since the joints are electromagnetically sensed, the operation of the mass change detection structure is independent of the internal configuration of the joints or other changed mass sections of the tubular structure.

DETAILED DESCRIPTION

Figure 1:
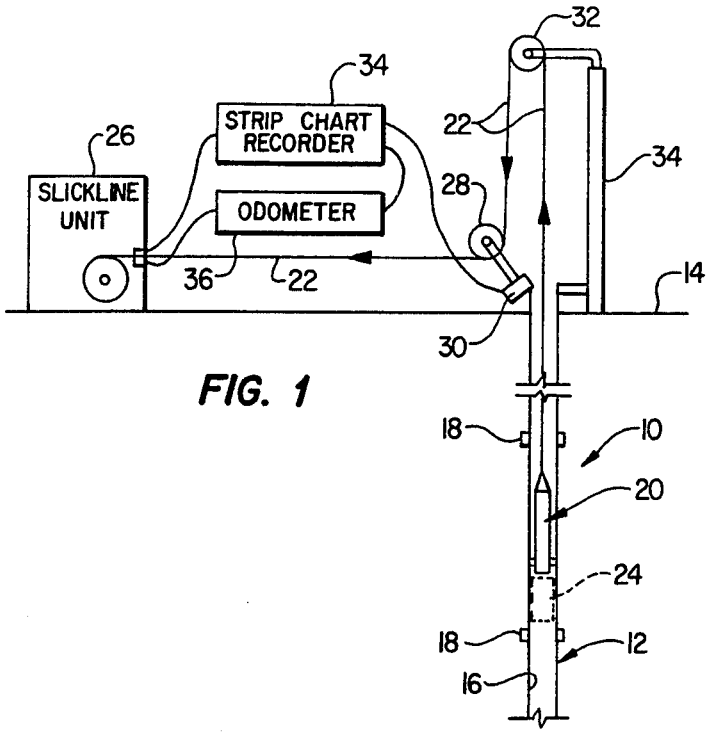
FIGS. 1 and 2 are schematic illustrations of a well bore tubular structure joint logging and tool location method performed using a specially designed electromechanical joint logging structure embodying principles of the present invention.
Figure 2:
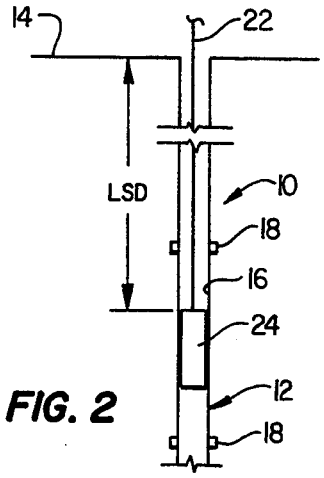

Schematically illustrated in FIGS. 1 and 2 is a representative subterranean well completion 10 in which a tubular casing structure 12 extends downwardly from the earth's surface 14 and interiorly lines a bore hole 16. As is customary, the casing 12 is formed from individual lengths of tubular casing material joined end-to-end by casing collar joints 18.

The present invention provides a specially designed collar logging structure 20 (see FIG. 1) which is lowered into the casing 12 on a length of slick line 22 and is used to detect a predetermined number of the collars 18, in a manner subsequently described, for use in accurately positioning a tool, such as the perforating gun 24 shown in FIG. 2, in the casing 12 relative to a well structure (such as casing perforations) previously installed therein.

The slick line 22 is stored in a conventional surface slick line unit 26. From the unit 26 the slick line 22 passes under a lower pulley 28 connected in a force transmitting relationship to a load cell 30, over an upper pulley 32 mounted on a stanchion structure 34, and is secured at its lower end to the upper end of the collar detection structure 20. A conventional single pen strip chart recorder 34 and an odometer 36 are operatively interconnected between the slick line unit 26 and the load cell 30 as schematically indicated in FIG. 1.

In performing the collar logging operation, the collar detection structure 20 is lowered on the slick line 22 into the casing 12 to the general depth therein (as indicated on the odometer 22) at which the tool 24 is to be subsequently located. The slick line 22 is then reeled in at a relatively slow controlled rate to move the collar detection structure 20 upwardly past a predetermined number of casing collar joints 18 (for example, ten collar joints) in the region of interest.

In a manner subsequently described, the collar or joint detection structure 20 electromagnetically detects each of the collars through which it upwardly passes. In response to its sensing of each of the collars 18 the structure 20 is automatically brought into a momentary motion inhibiting engagement with the interior surface of the casing 12, thereby mechanically creating detectable increases or "spikes" **38*a* in the line pull line 38 being marked on the moving recorder strip 40 (see FIG. 3). The longitudinal movement velocity of the strip 40 is appropriately correlated to the upward velocity of the collar detection structure 20 within the casing 12, and the tension spikes 38*a* are aligned with corresponding odometer readings on the odometer scale portion of the strip 40**.

Figure 3:
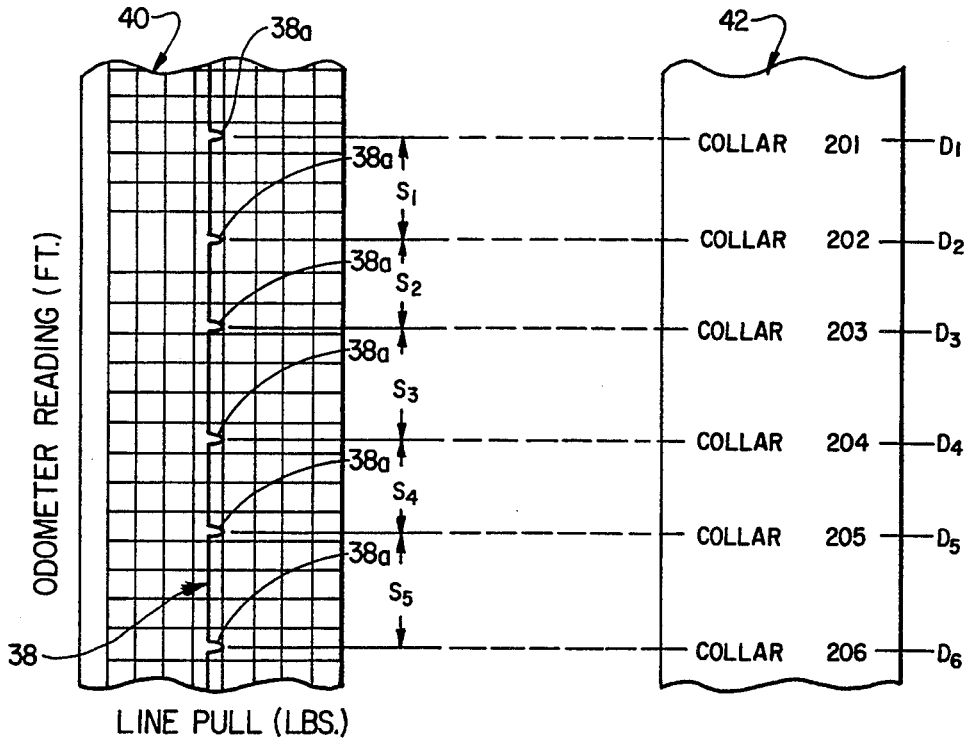
FIG. 3 is a schematic illustration of a strip chart/joint and tally log correlation technique used in conjunction with the joint logging method.

A representative six tension increase spikes **38*a* are depicted on the chart recorder strip 40 shown in FIG. 3 and correspond to six detected collar joints 18, the five slick line distances $S_1$–$S_5$ being indicative of the slick line distances between the vertically successive pairs of collar joints as may be determined from the odometer scale on the strip 40. In the correlative collar logging procedure being discussed herein, a matching set of collar-to-collar distances $S_1$–$S_5$ is found on the well's previously recorded collar log and tally 42 to determine, for example, that the collars located by the collar detection structure 20 are collars 201 through 206** respectively located at depths $D_1$–$D_6$ in the well casing.

This determination of the exact collars logged by the collar detection structure 20 permits the operator of the slick line unit 26, by comparing the odometer readings on the strip 40 at each tension spike 38*a* to the actual casing depths $D_1$–$D_6$, to arrive at a conversion factor that accurately relates the slick line odometer reading to the actual depth to which the collar detection structure has been lowered into the casing 12. After this conversion factor, which compensates for slick line stretch, has been determined the collar detection structure 20 may be pulled out of the casing 12, and replaced with the tool 24 (see FIG. 2) which may then be lowered on the slick line 22 into the casing 12 to a lowered slick line depth LSD (as indicated on the odometer 36) equal to the desired tool depth as corrected by the previously determined conversion factor.

Alternatively, as schematically illustrated in dotted lines in FIG. 1, the tool 24 may be lowered into the casing 12 on the collar detection structure 20 and used without removing the structure 20 from the casing. This method of utilizing the detection structure 20 is seen to be preferable since both the logging operation and the subsequent use of the tool 24 may be carried out in a single trip down the casing 12. Additionally, since the weight on the slick line 22 is the same in both the logging operation and the subsequent use of the tool, the positioning of the tool 24 will be even more precise.

According to a key feature of the present invention, the collar detection structure 20 frictionally creates detectable slick line tension increases corresponding to the detected collar locations, thereby eliminating the previous necessity of transmitting an electrical detection signal upwardly through an electrically conductive wire extending from the collar sensor to the surface. Thus, the need for a wireline, with its attendant crew and expense, is eliminated. Moreover, as will be seen, the creation of the mechanical collar detection signals by the structure 20 is not dependent on the geometry of the sensed collars. Specifically, the collar detection structure 20 may be used to sense either recessed or flush-type collar joints.

Figure 4:
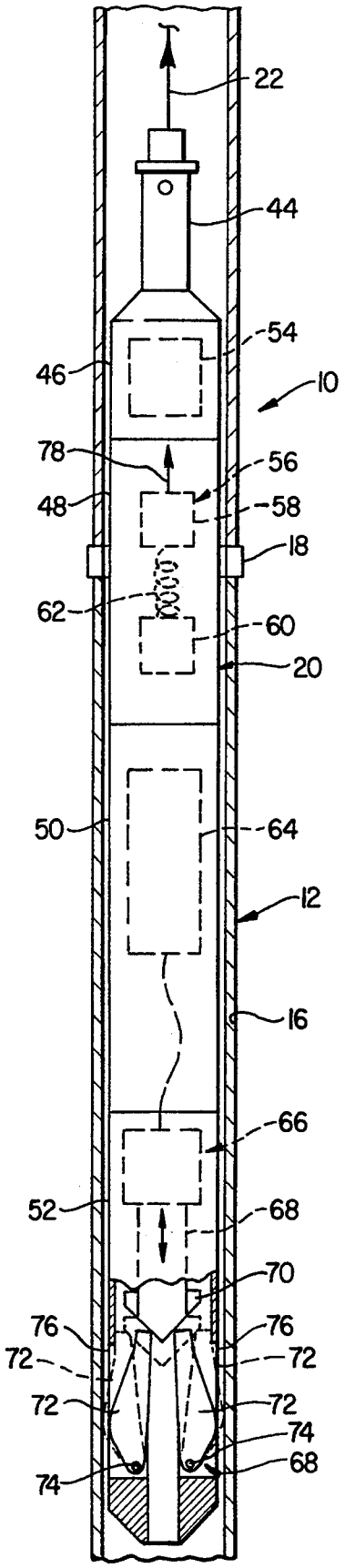
FIG. 4 is an enlarged scale, partially elevational schematic cross-sectional view through the joint logging structure.

Turning now to FIG. 4, the collar detection structure 20 has an elongated cylindrical configuration with, from top to bottom along its length, a connection section 44 to which the lower end of the slick line 22 may be secured; a control section 46; a sensor section 48; a battery pack section 50; and a solenoid and drag structure section 52. A control and timing circuit 54 is disposed in section 46, and a conventional electromagnetic mass sensing structure 56, comprising a vertically spaced pair of magnets 58, 60 between which a coil 62 is connected, is disposed within the section 48. Coil 62 is operatively connected to the control section 46. Control section 46 is operatively connected to a storage battery 64 which is disposed in section 50 and is, in turn, operatively connected to a solenoid structure 66 disposed within the section 52 above a drag structure 68 therein.

The solenoid structure 68 has a vertically reciprocable plunger portion 68 with a tapered lower end 70. Lower plunger end 70 is positioned above the upper ends of a diametrically opposed pair of vertically elongated drag arm members 72 which are pivotally secured at their lower ends, as at 74, within the bottom section 52. The drag arm members 72 are disposed at vertically extending slots 76 in section 52 for pivotal movement between their solid line release positions, in which the drag members are positioned within the section 52, and their dotted line casing engagement positions in which the drag members 72 extend outwardly through the slots 76.

After the collar detection structure 20 has been lowered on the slick line 22 into the casing 12 past the vertical series of collars 18 to be logged by the detection structure, the slick line 22 is pulled upwardly to move the detection structure 20 upwardly through the collars. As the sensor section 48 upwardly traverses each collar joint 18 the sensing structure 56 electromagnetically senses the increased casing mass created by the collar and responsively outputs an electrical signal 78 to the control section 46. In response to the creation of this electrical output signal 78 the battery 64 momentarily energizes the solenoid 66 and causes its plunger portion 68 to be downwardly driven to its indicated dotted line position to thereby cause the plunger bottom end portion 70 to forcibly engage the upper ends of the drag arm members 72.

This momentary forcible engagement of the upper drag member ends by the bottom plunger end portion 72 pivots the drag arm members 72 from their solid line positions to their dotted line positions in which outer side portions of the drag arm members forcibly engage the interior side surface of the casing 12, thereby momentarily increasing the tension in the slick line 22 and creating one of the line pull spikes 38*a* on the recorder strip 40 (see FIG. 3). The solenoid plunger 68 is then upwardly retracted to permit the drag arm members 72 to pivot inwardly to their solid line release positions, thereby causing the recorder strip tension line 38 to return to its baseline level.

As the sensor section 48 upwardly traverses each vertically successive collar joint 18 to be logged, this process of momentarily increasing the slick line tension is repeated by again energizing and quickly deenergizing the solenoid 64 to forcibly pivot the drag arm members 72 outwardly through the detection structure body slots 76 and then permit them to inwardly pivot to their retracted release positions.

The schematically depicted control and timing circuit 54 is of a conventional construction and operates in the same general manner as the timing circuitry typically incorporated in electromagnetic collar sensors used in conventional wireline collar logging systems. Prior to the lowering of the collar detection structure 20 into the casing 12 a time-down portion of the circuit 54 is set to disable operation of the solenoid for a predetermined time period. This prevents the drag arm members 72 from being driven into forcible frictional engagement with the casing 12 each time the collar detection structure 20 passes downwardly through a casing collar on its way down to its starting position within the casing. When the detection structure 20 reaches such starting position (i.e., just below the vertical series of collars to be logged) it is permitted to remain motionless within the casing for the balance of this initial preset time-down period.

A conventional pre-set still time detector and a motion detector incorporated in the control section 46 cooperate to prevent the drag structure from working until the detection structure 20 has remained motionless for this time-down period. The circuitry in the control section 46 operates in a manner such that if motion of the detection structure 20 is detected within this initial time-down period the still-time clock is automatically reset to zero lapsed time. Only when the detection structure 20 remains motionless for the time-down period will the control section circuitry arm the drag structure. Once armed, the drag structure is operative only for a preset armed period during which the motion detection portion of the circuitry is bypassed. After the armed period has expired the drag structure is automatically rendered inoperative, and to reset the arming circuitry the detection structure must be pulled to the surface and reset.

Figure 5:
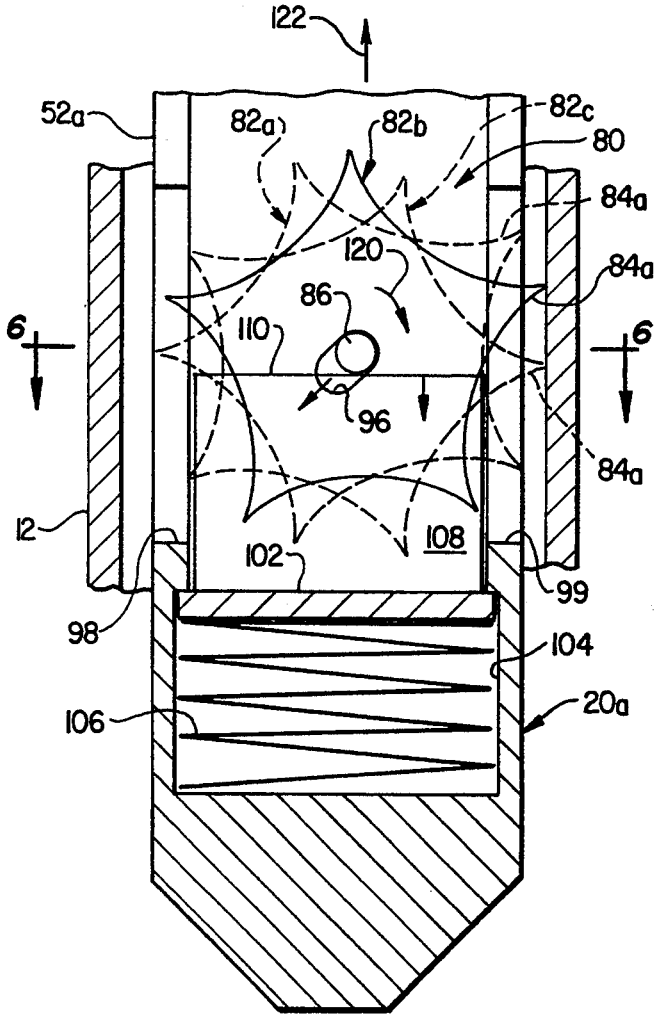
FIG. 5 is an enlarged scale partly schematic cross-sectional view through a lower end portion of an alternate embodiment of the joint logging structure.

A lower end portion of an alternate embodiment 20*a* of the previously described collar detection structure 20 is cross-sectionally illustrated in FIG. 5 in a simplified, somewhat schematic form. The collar detection structure 20*a* is identical to the structure 20 with the exception that a modified drag structure 80 is incorporated in its solenoid and drag structure section 52*a*. The modified drag structure 80 includes a drag wheel 82 which is shown in three rotational positions in FIG. 5—(1) an initial dotted line position 82*a*; (2) a second, solid line position 82*b* in which the drag wheel has been rotated a short distance away from position 82*a* in a clockwise direction; and (3) a third, dotted line position 82*c* in which the drag wheel has been rotated a short distance away from position 82*b* in a clockwise direction.

Referring now to FIGS. 5–9, the drag wheel 82 has formed thereon a circumferentially spaced series of radially outwardly projecting points 84 including the reference point 84*a* which will be subsequently used herein to describe the operation of the modified drag structure 80. A cylindrical support shaft 86 is fixedly secured to and transversely extends centrally through the drag wheel 80, and longitudinally extends outwardly beyond detent and ratchet boss structures 88 and 90 fixedly secured on opposite sides of the drag wheel 82. For purposes later described, the boss 88 has a series of flat side surfaces 92 disposed around its lateral periphery, and the boss 90 has a circumferentially spaced series of generally tangentially facing driving surfaces 94 formed around its lateral periphery.

Figure 6:
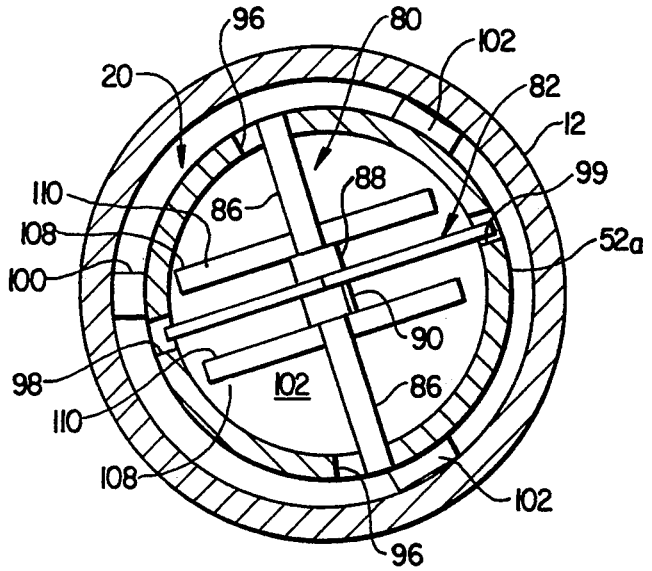
FIG. 6 is a simplified cross-sectional view through the alternate joint logging structure taken along line 6—6 of FIG. 5.

As best illustrated in FIGS. 5 and 6, the outer ends of the shaft 86 are received in elongated, vertically inclined slots 96 formed in diametrically opposite side wall portions of the hollow body of the solenoid and drag structure section 52*a*. Additionally, opposite side edge portions of the drag wheel 82 are aligned with, and may be rotated outwardly through, a diametrically opposite pair of vertically elongated slots 98, 99 formed in the side wall portion of the section 52*a*. The section 52*a* is resiliently maintained in a laterally spaced relationship with the interior side surface of the casing 12 by means of a lug member 100 and a pair of leaf spring members 102 externally secured to and circumferentially spaced around the section 52*a* and bearing against the inner side surface of the casing 12. The radial thickness of the lug member 100 is sized in a manner such that, for purposes later described herein, the vertical slot 99 is somewhat closer to the interior surface of the casing 12 than the vertical slot 98 is.

Figure 7:
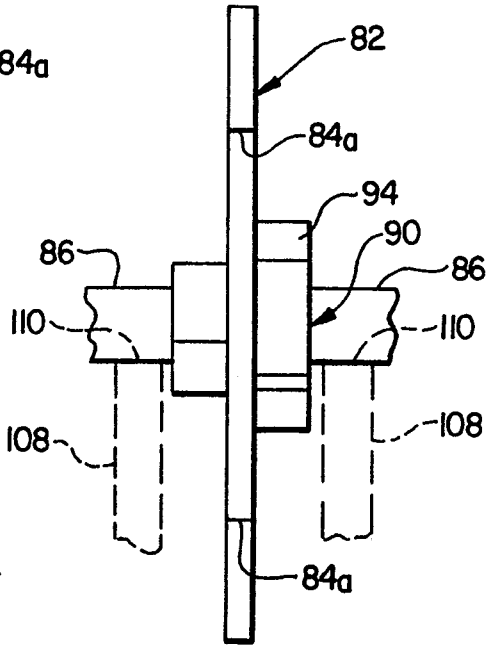
FIG. 7 is an enlarged scale side edge elevational view of a drag member used in the alternate embodiment of the joint logging structure.

A pressure plate member 102 is slidably retained and vertically movable within a complementarily configured chamber 104 formed in the body of section 52*a*. Pressure plate member 102 is resiliently biased toward its upper limit position indicated in FIG. 5 by a schematically depicted compression spring 106 disposed in the chamber 104 and bearing at its opposite ends against the bottom end surface of the chamber and the underside of the pressure plate 102. Extending upwardly from the top side of the pressure plate 102 are a spaced pair of biasing plates 108 having upper edge surfaces 110 that upwardly bear against opposite end portions of the shaft 86 as best illustrated in FIGS. 6 and 7. Accordingly, due to the biasing force of the spring 106 (see FIG. 5) the opposite ends of the shaft 86 are biased toward the upper ends of the body wall slots 96, thereby also resiliently holding the drag wheel in a position in which it is slightly offset to the right of the vertical axis of the detection structure 20*a* as viewed in FIG. 5.

Figure 8:
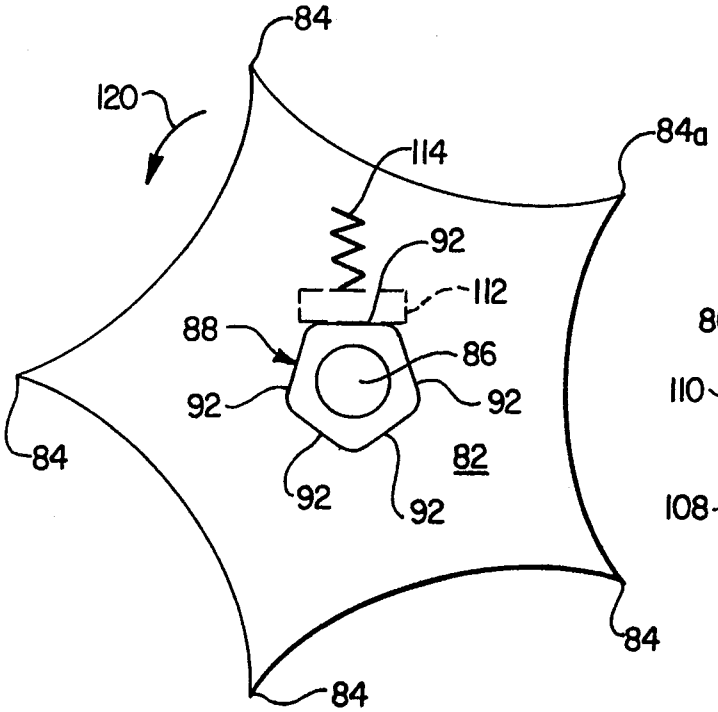
FIG. 8 is a left side elevational view of the drag member.

As schematically shown in FIG. 8, a small detent plate 112 is biased downwardly into resilient engagement with the uppermost lateral side surface 92 of the detent boss 88 by means of a spring 114. This resiliently inhibits rotation of the shaft 86. Forced rotation of the shaft 86 lifts the plate 112 and then permits it to be driven downwardly onto the next adjacent side surface portion 92 by the spring 114.

Figure 9:
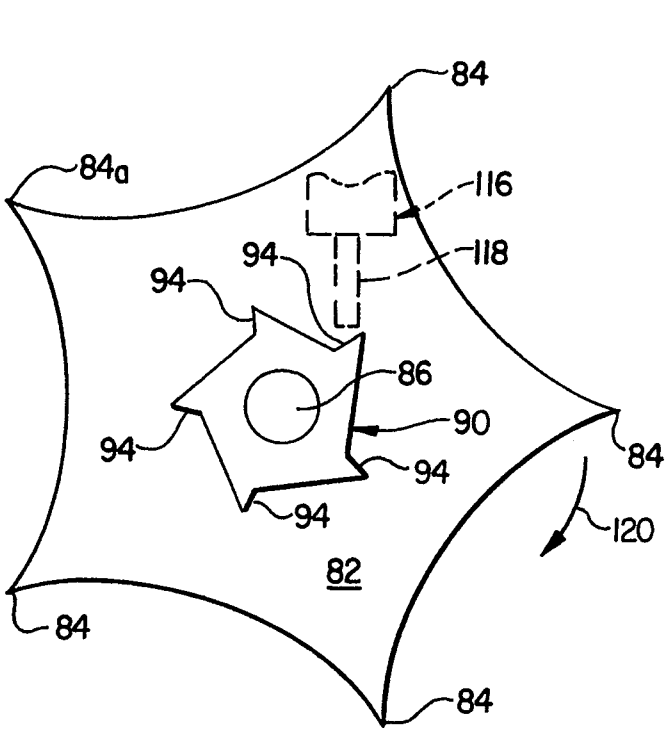
FIG. 9 is a right side elevational view of the drag member.

As schematically shown in FIG. 9, an electrically drivable solenoid structure 116 is disposed above the ratchet boss 90, in a rightwardly offset relationship therewith, and has a downwardly projecting, vertically reciprocable plunger portion 118 positioned to downwardly and drivingly engage one of the boss driving surfaces 94 to rotate the drag wheel 82 in the direction indicated by the arrows 120 in FIGS. 8 and 9. The solenoid 116 is coupled to the battery 64 (see FIG. 4), and momentarily actuated in response to the generation of the electrical output signal 78, in the same manner as the previously described solenoid 66 incorporated in the collar detection structure 20.

Referring again to FIG. 5, prior to the momentary actuation of the solenoid 116 in response to the generation of the electrical output signal 78 the drag wheel 82 is resiliently held in its initial rotational position 82*a* by the engagement of the detent plate 112 (see FIG. 8) with the uppermost side surface portion 92 of the detent boss 88. None of the drag wheel points 84 are in engagement with the interior side surface of the casing 12, and the reference wheel point 84*a* projects at an upwardly and rightwardly inclined angle as viewed in FIG. 5.

As the collar detection structure 20*a* is being pulled upwardly through the casing 12, as indicated by the arrow 122 in FIG. 5, and the solenoid 116 is momentarily energized in response to the sensing of a collar joint 18, the solenoid plunger 118 is driven downwardly into engagement with a facing one of the ratchet boss drive surfaces 94 (see FIG. 9), in a manner rotating the drag wheel from its initial position 82*a* to its second rotational position 82*b*, and is then retracted. When the drag wheel 82 reaches its position 82*b* the reference point 84*a* engages the interior side surface of the casing 12.

Further upward movement of the collar detection structure 20*a* through the casing 12 causes the point-engaged casing interior surface portion to forcibly rotate the drag wheel 82 in direction 120 while at the same time forcing the ends of the drag wheel shaft 86 downwardly and to the left in their associated body slots 96.

This downward movement of the shaft ends in the slots 96 caused the pressure plate 102 to be downwardly driven against the resilient force of the spring 106. Accordingly, both the rotation of the drag wheel 82 past its position 82*b* and its leftward shifting are resiliently resisted by the spring 116. This resilient resistance creates a momentarily increased tension force in the slick line 22, thereby correspondingly creating another tension spike 38*a* on the recorder strip 40 (see FIG. 3).

The drag wheel is then rotated to its position 82*c* at which time the reference wheel point 84*a* is driven over center to permit the spring 106 to return the drag wheel to its original position 82*a*, the drag wheel being releasably held in such original position (until the solenoid 116 is again actuated) by the resilient engagement of the detent plate 112 (see FIG. 8) with the next adjacent boss side surface 92). It should be noted that, due to the previously mentioned rightward offset of the section 52*a* in the casing 12 (as viewed in FIG. 5), none of the drag wheel points 84 come into engagement with the left side of the interior casing side surface.

As will be appreciated, a variety of other types of drag structures could be alternately utilized if desired. Additionally while the elongated positioning member used to lower the collar detection structure 20 or 20*a* into the casing 12 is representatively a slick line, a variety of other elongated positioning members (such as coil tubing or braided metal line) could be alternately utilized if desired. Additionally, while the detection structures 20 and 20*a* have been illustrated and described herein as being used to sense casing collar joints or other increased mass sections of the casing, it will be appreciated by those of skill in this particular art that they could also be used in various applications to detect decreased mass sections of the casing, such as perforated portions thereof.

Moreover, as will be readily appreciated by those of skill in this particular art, the detection structures 20 and 20*a* could also be advantageously utilized to detect changed mass sections in other types of downhole jointed tubular structures, such as production tubing, in subterranean wells.

The foregoing detailed description is to be clearly understood as being given by way of illustration and example only, the spirit and scope of the present invention being limited solely by the appended claims.

What is claimed is:

1. A method of accurately determining the depth of a changed mass section of a jointed tubular structure in a subterranean well, such as a well bore casing or production tubing, without the necessity of transmitting electrical signals upwardly to the surface through an electrically conductive wire line member, said method comprising the steps of:

lowering a detection structure, on an elongated positioning member, into the tubular structure to a position therein below the changed mass section therein whose depth is to be determined;

pulling on the elongated positioning member to move the lowered detection structure upwardly through the changed mass section of the tubular structure;

causing the upwardly moving detection structure to automatically generate an electrical signal as it moves upwardly through the changed mass section;

using the generated electrical signal to drive a portion of said detection structure into forcible engagement with the interior surface of the tubular structure in a manner detectably increasing the tension in said elongated positioning member;

detecting the momentary tension increase in said elongated positioning member; and using the detected positioning member tension increase to determine the surface-to-detection structure length of the elongated positioning member at the creation of the tension increase.

2. The method of claim 1 wherein:

said lowering step is performed by lowering said detection structure into the tubular structure on a slick line.

3. The method of claim 1 wherein:

said changed mass section is a casing collar joint, and said causing step is performed by causing the upwardly moving detection structure to automatically generate an electrical signal as it moves upwardly through the casing collar joint.

4. A method of logging a series of joints in a jointed tubular structure, such as a well bore casing or production tubing, in a subterranean well, said method comprising the steps of:

lowering a joint detection structure into the tubular structure on an elongated positioning member;

longitudinally moving the elongated positioning member to correspondingly move the lowered joint detection structure through a series of joints in the jointed tubular structure;

causing a portion of the moving joint detection structure to electromagnetically sense each joint through which it passes;

creating a detectable, momentary tension change in said elongated positioning member in response to the electromagnetic sensing of each joint through which said joint detection structure moves;

detecting each momentary tension change in said elongated positioning member; and determining the downhole length of said elongated positioning member corresponding to each detected tension change therein.

5. The method of claim 4 wherein:

said step of creating a detectable, momentary tension change includes the step of bringing a portion of said joint detection structure into momentary forcible engagement with the interior of said tubular structure.

6. The method of claim 4 wherein:

said longitudinally moving step is performed by upwardly moving the elongated positioning member to correspondingly move the lowered joint detection structure upwardly through the series of joints.

7. A method of accurately determining the depths of a longitudinally spaced plurality of joints in a downhole jointed tubular structure, such as a well bore casing or production tubing, in a subterranean well, said method being independent of the configuration of the joints and comprising the steps of:

providing a joint detection structure;

securing said joint detection structure to an end of an elongated positioning member;

lowering said joint detection structure into the tubular structure on said elongated positioning member to a tubular structure location below the spaced plurality of joints therein whose depths are to be determined;

pulling on said elongated positioning member to move the lowered joint detection structure upwardly through the spaced plurality of joints;

causing the upwardly moving joint detection structure to generate an electrical signal as it interiorly traverses each of the spaced plurality of joints;

momentarily bringing a portion of said joint detection structure into forcible contact with the interior surface of the jointed tubular structure, in response to the generation of each electrical signal, in a manner detectably increasing the tension in said elongated positioning member;

detecting the momentary tension increases in said elongated positioning member; and utilizing the detected tension increases to determine the depths of each of the spaced plurality of joints.

8. The method of claim 7 wherein:

said securing step is performed by securing said joint detection structure to an end of a slick line.

9. The method of claim 7 further comprising the steps of:

using the determined depths of the joints to determine the spacing between each vertically adjacent pair of the plurality of joints, matching the set of determined joint-to-joint spacings to a corresponding set of joint-to-joint spacings on a previously recorded joint log and tally to determine precisely which joints have been logged using said joint detection structure.

10. A method of positioning a tool within a downhole tubular structure, such as a well bore casing or production tubing, in a subterranean well, at a precise, predetermined distance from a previously installed structure therein, the tubular structure having a longitudinally spaced series of joints and a joint and tally log indicating the depth of the previously installed structure in the tubular structure, said method comprising the steps of:

lowering a joint detection structure into the tubular structure on an elongated positioning member;

pulling on said elongated positioning member to raise the lowered joint detection structure through the joints in a predetermined longitudinal portion of the tubular structure;

causing the upwardly moving joint detection member to automatically generate an electrical signal each time it passes through one of the joints in said predetermined longitudinal portion of the tubular structure;

momentarily bringing the upwardly moving joint detection member into forcible, motion inhibiting engagement with the tubular structure, in response to each of the generated electrical signals, in a manner detectably increasing the tension in said elongated positioning member;

detecting the tension increases in said elongated positioning member;

utilizing the detected tension increases to measure the distance between each longitudinally successive pair of the joints in said predetermined longitudinal portion of the tubular structure by recording the downhole length of said elongated positioning member corresponding to each detected tension increase therein;

correlating the measured joint-to-joint distances to dimensional data in the joint and tally log in a manner establishing a positioning member run-in length precisely corresponding to the desired tool depth in the tubular structure; and supporting the tool within the tubular structure on an elongated positioning member having a downhole length identical to the positioning member run-in length established in said correlating step.

11. The method of claim 10 wherein:

said supporting step is performed using the same elongated positioning member used in said lowering step.

12. The method of claim 11 wherein:

said tool is lowered into the tubular structure with said joint detection structure on said elongated positioning member.

13. A detection structure, movable upwardly through a downhole jointed tubular structure, such as well bore casing or production tubing in a subterranean well, on an end of an elongated positioning member extending into the tubular structure, for detecting the location of a changed mass portion of the tubular structure such as a joint therein, said detection structure comprising:

first means for sensing the changed mass portion as said detection structure passes upwardly therethrough, and responsively generating an electrical output signal; and second means, responsive to the generation of said electrical output signal, for bringing a portion of said detection structure into forcible contact with the tubular structure in a manner momentarily inhibiting the further movement of said detection structure through the tubular structure and thereby creating in the elongated positioning member a detectable tension increase indicative of the downhole position of the sensed changed mass portion of the tubular structure.

14. The detection structure of claim 13 wherein:

said first means are operative to electromagnetically sense the changed tubular structure mass portion.

15. The detection structure of claim 14 wherein:

said first means include an electromagnetic coil structure.

16. The detection structure of claim 13 wherein:

said second means include a drag structure movable relative to the balance of said detection structure, and means for momentarily moving said drag structure into frictional, motion inhibiting engagement with the interior surface of the tubular structure in response to the generation of said electrical output signal.

17. The detection structure of claim 16 wherein:

said detection structure has a generally tubular body portion with a diametrically opposed pair of longitudinally extending slots therein, said drag structure includes a pair of drag arm members carried within said body portion for pivotal movement relative thereto into and out of said slots, and said means for momentarily moving said drag structure includes a battery driven solenoid structure operative to pivotally drive said drag arm members outwardly through said slots in response to the generation of said electrical output signal.

18. The detection structure of claim 16 wherein:

said detection structure has a generally tubular body portion with a longitudinally extending slot therein, said drag structure includes a drag wheel member rotationally carried within said body portion and having a circumferentially spaced series of point portions disposed thereon and sequentially extendable outwardly through said slot into engagement with the interior surface of the tubular structure in response to rotation of said drag wheel member, means for resiliently supporting said drag wheel member for downwardly and laterally inwardly sloped movement relative to said body portion in response to engagement of one of said point portions with the interior surface of the tubular structure during upward movement of said detection structure through the tubular structure, and said means for momentarily moving said drag structure include means for forcibly rotating said drag wheel member relative to said body portion in response to the generation of said electrical output signal.

19. The detection structure of claim 18 wherein:

said drag wheel has a ratchet boss disposed on one side thereof and having a circumferentially spaced series of generally tangentially facing driving surfaces thereon, and said means for forcibly rotating said drag wheel member include a battery driven solenoid structure operative to forcibly engage one of said driving surfaces in response to the generation of said electrical output signal.

20. The detection structure of claim 19 further comprising:

a detent boss disposed on the other side of said drag wheel and having a circumferentially extending series of flat side portions thereon, a detent plate positioned against one of said flat side portions, and spring means for resiliently holding said detent plate against said one of said flat side portions.

21. The detection structure of claim 18 wherein:

said body portion has a diametrically opposed pair of vertically sloped support slots formed therein and having upper ends, said drag wheel is centrally supported on a shaft member having opposite ends rotationally and laterally movably carried within said support slots, and said detection structure further comprises biasing means for resiliently biasing said shaft member ends toward said upper ends of said support slots.

22. The detection structure of claim 21 wherein:

said biasing means include a biasing member supported for vertical movement within said body portion and upwardly engaging said shaft member, and spring means resiliently urging said biasing member in an upward direction.

23. A detection structure, upwardly movable through a downhole jointed tubular structure, such as well bore casing or production tubing in a subterranean well, on an end of an elongated positioning member extending into the tubular structure, for detecting the downhole locations of a spaced series of joints in the tubular structure, said detection structure comprising;

joint sensing means operative to sense each joint through which said detection structure passes, as it is upwardly moved through the tubular structure on the elongated positioning member, and responsively generate an electrical output signal;

drag means momentarily movable into forcible engagement with the tubular structure in a manner momentarily inhibiting the further movement of said detection structure through the tubular structure and thereby creating in the elongated positioning member detectable tension increases indicative of the downhole positions of the sensed joints;

electrically powerable force transmitting means, operable in response to the generation of each electrical output signal, for engaging said drag means and momentarily moving them into forcible engagement with the tubular structure; and battery means for supplying electrical power to said force transmitting means.

24. The detection structure of claim 23 wherein:

said joint sensing means include an electromagnetic coil structure.

25. The detection structure of claim 23 wherein:

said drag means include a pivotally supported arm structure, and said force transmitting means include an electrically powerable solenoid structure.

26. The detection structure of claim 23 wherein:

said drag means include a rotationally supported drag wheel having a circumferentially spaced series of point portions thereon, and said force transmitting means include an electrically powerable solenoid structure.

* * * * *